US009822612B2

(12) United States Patent
Steele et al.

(10) Patent No.: US 9,822,612 B2
(45) Date of Patent: Nov. 21, 2017

(54) JUNCTION-CONVEYED COMPLETION TOOLING AND OPERATIONS

(71) Applicant: Halliburton Energy Services, Inc., Houston, TX (US)

(72) Inventors: David J. Steele, Arlington, TX (US); Matthew B. Stokes, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/786,107

(22) PCT Filed: Jul. 28, 2014

(86) PCT No.: PCT/US2014/048453
§ 371 (c)(1),
(2) Date: Oct. 21, 2015

(87) PCT Pub. No.: WO2016/018223
PCT Pub. Date: Feb. 4, 2016

(65) Prior Publication Data
US 2017/0130564 A1 May 11, 2017

(51) Int. Cl.
*E21B 41/00* (2006.01)
*E21B 43/04* (2006.01)
(Continued)

(52) U.S. Cl.
CPC ..... *E21B 41/0035* (2013.01); *E21B 23/01* (2013.01); *E21B 33/14* (2013.01);
(Continued)

(58) Field of Classification Search
CPC ..... E21B 23/01; E21B 33/12; E21B 33/14; E21B 41/0035; E21B 43/04; E21B 43/08
See application file for complete search history.

(56) References Cited

U.S. PATENT DOCUMENTS 6,315,054 B1 11/2001 Brunet
2002/0104659 A1 8/2002 Buyers et al.
(Continued)

FOREIGN PATENT DOCUMENTS

WO WO-2004065917 A2 8/2004

OTHER PUBLICATIONS

International Search Report and Written Opinion, dated Apr. 24, 2015, 13 pages; Korean International Searching Authority.
(Continued)

*Primary Examiner* — James G Sayre
(74) *Attorney, Agent, or Firm* — Haynes and Boone, LLP

(57) ABSTRACT

An assembly and method for completion of lateral wellbores is disclosed. The completion assembly includes a junction fitting with main and lateral legs, and a lateral completion string and anchoring device connected to the downhole end of the lateral leg and the uphole end of the junction fitting, respectively. A working string, positioned within the lateral leg, anchoring device, and lateral completion string, includes a setting tool that is removably connected to the anchoring device and a completion tool assembly located within the lateral completion string. The completion assembly is run by the working string into the wellbore. After setting the anchoring device, the working string conveys the completion tool assembly within the lateral completion string for gravel packing, fracturing, frac-packing, acidizing, cementing, perforating, and inflating packers, for example. After wellbore completion, the completion tool assembly is removed through the lateral leg of the junction fitting.

13 Claims, 9 Drawing Sheets

(51) Int. Cl.

| | |
|---|---|
| ***E21B 33/14*** | (2006.01) |
| ***E21B 23/01*** | (2006.01) |
| *E21B 33/12* | (2006.01) |
| *E21B 43/08* | (2006.01) |

(52) U.S. Cl.
CPC ..... *E21B 43/04* (2013.01); *E21B 33/12* (2013.01); *E21B 43/08* (2013.01)

(56) References Cited

U.S. PATENT DOCUMENTS

| | | | | |
|---|---|---|---|---|
| 2002/0157826 | A1* | 10/2002 | MacKenzie ..... | E21B 41/0042 166/277 |
| 2004/0168809 | A1 | 9/2004 | Nobileau | |
| 2004/0182579 | A1 | 9/2004 | Steele et al. | |
| 2010/0212913 | A1 | 8/2010 | Renshaw et al. | |
| 2013/0319666 | A1* | 12/2013 | Nygardsvoll ..... | E21B 41/0035 166/278 |

OTHER PUBLICATIONS

Halliburton, Liner-Conveyed Gravel Pack System, 2011, 2 pages, http://www.halliburton.com/public/cps/contents/Brochures/web/H07934.pdf.

* cited by examiner

JUNCTION-CONVEYED COMPLETION TOOLING AND OPERATIONS

CROSS REFERENCE TO RELATED APPLICATIONS

The present application is a U.S. National Stage patent application of International Patent Application No. PCT/US2014/048453, filed on 28 Jul. 2014, the benefit of which is claimed and the disclosure of which is incorporated herein by reference in its entirety.

TECHNICAL FIELD

The present disclosure relates generally to operations performed and equipment used in conjunction with a subterranean well such as a well for recovery of oil, gas, or minerals. More particularly, the disclosure relates to well completion systems and methods.

BACKGROUND

The drilling and completion of one or more lateral wellbores branching from a main wellbore to serve multiple production zones of a formation is a technique for developing complex hydrocarbon fields. In a typical process for completing a multilateral wellbore, one or more upper portions of the main wellbore may first be drilled, and a casing may be installed. After casing installation, a lower portion of the main wellbore may be drilled. One or more lateral wellbores may be drilled, typically after the main wellbore is completed or at least partially completed.

Completion operations, for both main and lateral wellbores, may include gravel packing, fracturing, acidizing, cementing, and perforating, for example, as well as running and hanging a completion string within the wellbore. Completion strings may include various completion equipment such as perforators, filter assemblies, flow control valves, downhole gauges, hangers, packers, crossover assemblies, completion tools, and the like.

BRIEF DESCRIPTION OF THE DRAWINGS

Embodiments are described in detail hereinafter with reference to the accompanying figures, in which.

DETAILED DESCRIPTION

Figure 1:
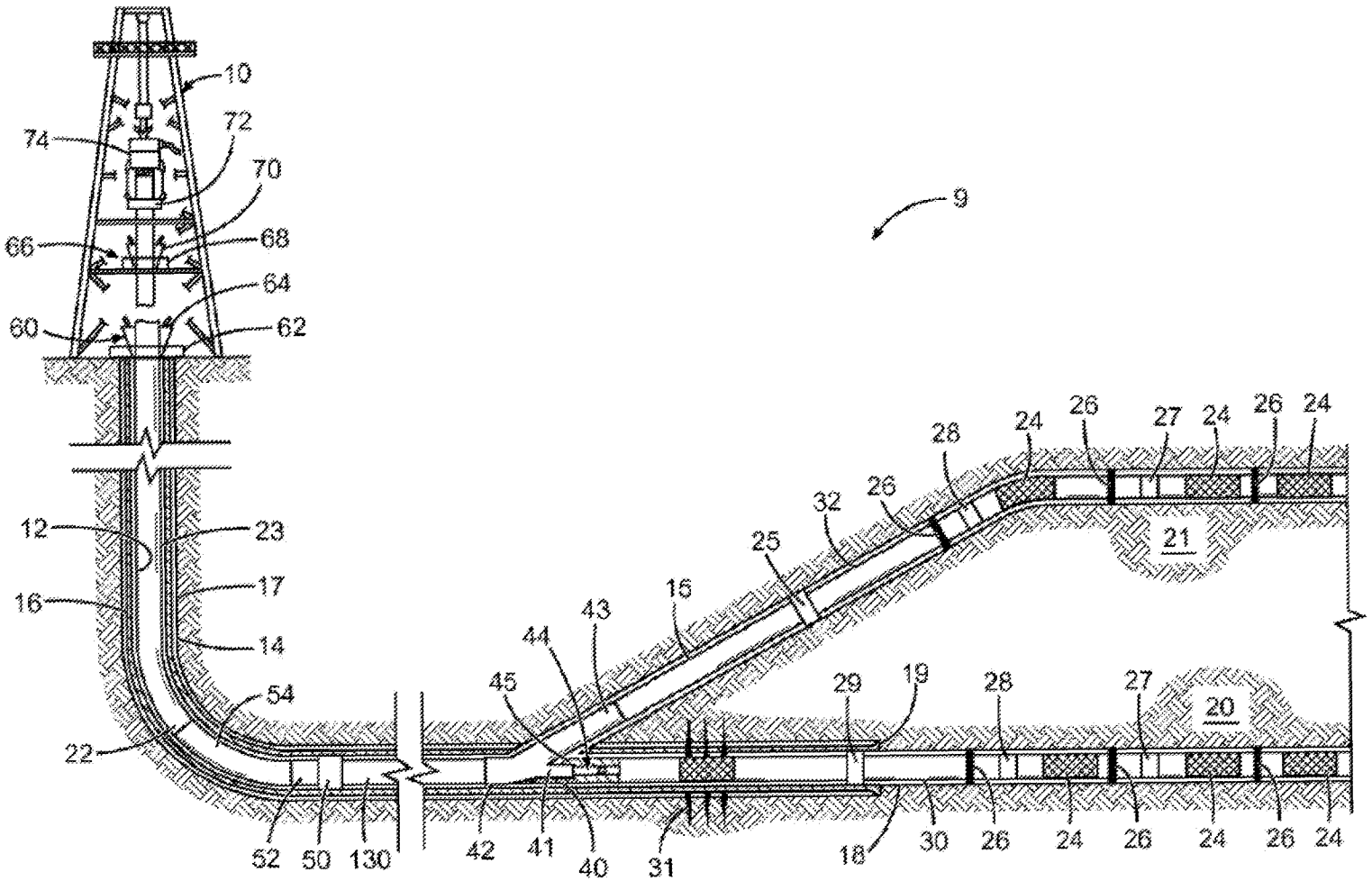
FIG. 1 is an elevation view in partial cross section of a portion of a multilateral well system according to an embodiment, showing a main wellbore, a lateral wellbore, a main completion string having a completion deflector located within a downhole portion of the main wellbore, a lateral completion string located within the lateral wellbore, a junction fitting joining the main and lateral completion strings, and an upper completion string connected to the uphole end of the junction fitting.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe relationships illustrated in the figures. The spatially relative terms are intended to encompass different orientations of the apparatus in use or operation in addition to the orientation disclosed in the specification. In addition, figures are not necessarily drawn to scale but are presented for ease of explanation.

In a typical process for completing a multilateral wellbore, one or more upper portions of the main wellbore may first be drilled and, a casing may be installed. After casing installation, a lower portion of the main wellbore may be drilled. Main wellbore completion operations may be performed prior to lateral wellbore completion operations. Completion operations may include gravel packing, fracturing, acidizing, cementing, and perforating, for example, as well as running and hanging a main completion string portion from wellbore casing within the main wellbore. The main completion string may include various completion equipment such as perforators, filter assemblies, flow control valves, downhole permanent gauges, hangers, packers, crossover assemblies, completion tools, and the like.

Lateral wellbore completion operations may be performed after completion equipment is installed in the main wellbore. Typically, a completion deflector may be installed at the multilateral junction to guide completion equipment into the lateral wellbore. As with the main wellbore, lateral wellbore completion operations may include gravel packing, fracturing, acidizing, cementing, and perforating, for example, as well as running and hanging a lateral completion string within the lateral wellbore. The lateral completion string may include perforators, filter assemblies, flow control valves, downhole permanent gauges, hangers, packers, crossover assemblies, completion tools, and the like.

After lateral wellbore completion operations have been performed, the working string used for installation, and any completion tools carried thereby, may be removed from the wellbore. Thereafter, a junction fitting may be installed at the lateral junction. The junction fitting may be a wye-shaped fitting that connects to the lateral completion string with a lateral leg and to the main completion string with a main leg. During installation, the lateral leg of the junction fitting may be deflected by the completion deflector into the lateral wellbore for connection to the lateral completion string, and the main leg of the junction fitting may include a stinger connector which mates with a receptacle in the completion deflector to connect the junction fitting with the main completion string. After the junction fitting is installed, an upper completion string may be run into the main wellbore and connected to the uphole end of the junction fitting.

In contrast, the present disclosure relates to a system and method in which a lateral completion assembly, including a generally wye-shaped junction fitting for attachment to both a main and lateral wellbore completion strings along with a lateral completion string and a completion tool assembly, may be run as a unit into a lateral wellbore. That is, as the junction fitting is lowered into position for attachment at the junction between the main and lateral wellbores, the lateral completion string and a completion tool assembly may be concurrently directed into and lowered into the lateral wellbore. A working string may be used to carry and position the junction fitting, lateral completion string, and completion tool assembly together during deployment. Once the junction fitting has been properly positioned and secured to the main completion string as desired, the working string may be released from the junction fitting, allowing lateral wellbore completion activities using the completion tool assembly. Thereafter, the completion tool assembly may be removed from the lateral wellbore via the working string through the lateral leg of the junction fitting.

With the forgoing in mind, FIG. 1 is an elevation view in partial cross-section of a well system, generally designated 9, according to an embodiment. Well system 9 may include drilling, completion, servicing, or workover rig 10. Rig 10 may be deployed on land or used in association with offshore platforms, semi-submersibles, drill ships and any other system satisfactory for completing a wellbore. A blow out preventer, christmas tree, and/or and other equipment associated with servicing or completing a wellbore (not illustrated) may also be provided.

Rig 10 may include upper and lower suspension members 60, 66. In an embodiment, lower suspension member 60 may include a rotary table 62 having a slip bowl formed therein and a set of slips 64. In an embodiment, upper suspension member 66 may include a false rotary table or a spider 68, for example, and a corresponding set of slips 70. Rig 10 may also include an elevator 72, swivel 74, and/or top drive (not illustrated). Elevator 72 may be suspended from swivel 74 74 in a manner that allows the distance between elevator 72 and swivel 74 to be selectively controlled. Alternatively, elevator 72 may be suspended independently of swivel 74. Upper and lower suspension members 60, 66, elevator 72, and swivel 74 may be used for assembling and running a lateral completion assembly, as described hereinafter.

In the illustrated embodiment, a wellbore 12 extends through various earth strata. Wellbore 12 may have a main wellbore 13, which may include a substantially vertical section 14. Main wellbore 13 may also have a substantially horizontal section 18 that extends through a first hydrocarbon bearing subterranean formation 20. As illustrated, a portion of main wellbore 13 may be lined with a casing string 16, which may be joined to the formation with casing cement 17. A portion of main wellbore 13 may also be open hole, i.e., uncased. Casing 16 may terminate at its distal end with a casing shoe 19.

Wellbore 12 may include at least one lateral wellbore 15, which may be open hole as illustrated in FIG. 1, or which may include casing (not illustrated). Lateral wellbore 15 may have a substantially horizontal section, which may extend through formation 20 or through a second hydrocarbon bearing subterranean formation 21. According to one or more embodiments, wellbore 12 includes multiple lateral wellbores (not expressly illustrated).

A tubing string 22, extending from the surface, may be positioned within wellbore 12. An annulus 23 is formed between the exterior of tubing string 22 and the inside wall of wellbore 12 or casing string 16. Tubing string 22 may provide a sufficiently large internal flow path for formation fluids to travel from formations 20, 21 to the surface (or vice versa in the case of an injection well), and it may provide for workover operations and the like as appropriate. Tubing string 22, which may also include an upper completion string segment 54, may be coupled via a junction fitting 42 to main completion string 30 and lateral completion string 32, as described in greater detail below.

Main and lateral completion strings 30, 32 may equally be used in open hole environments or in cased wellbores. In the latter case, casing 16, casing cement 17, and the surrounding formation may be perforated, such as by a perforating gun, creating openings 31 for flow of fluid from the formation into the wellbore.

Each completion string 30, 32 may include one or more filter assemblies 24, each of which may be isolated within the wellbore by one or more packers 26 that provide a fluid seal between the completion string and wellbore wall. Filter assemblies 24 may filter sand, fines and other particulate matter out of the production fluid stream. Filter assemblies 24 may also be useful in controlling the flow rate of the production fluid stream. Each completion string 30, 32 may also include flow control valves 27, downhole gauges 28, completion tools, and the like.

Well system 9 may include a completion deflector 40, which together with junction fitting 42, mechanically connects and fluidly joins main and lateral completion strings 30, 32 with tubing string 22. Junction fitting 42 may be connectable to completion deflector 40 within wellbore 12. Junction fitting 42 may conform with one of the levels defined by the Technology Advancement for Multilaterals (TAML) Organization, for example a TAML Level 5 multilateral junction.

In an embodiment, junction fitting 42 is generally wye-shaped and defines an uphole end joined to downhole main and lateral ends by main and lateral legs 41, 43, respectively. In one or more embodiments, main leg 41 junction fitting 42 may be shorter or longer than lateral leg 43, for example.

In an embodiment, completion deflector 40 may define uphole and downhole ends. The uphole end of completion deflector 40 may have an inclined surface 45 with a profile that laterally deflects equipment which contacts the surface. Completion deflector 40 may include a longitudinal internal passage formed therethrough, which may be dimensioned so that larger equipment is deflected off of uphole inclined surface 45, while smaller equipment is permitted to pass therethrough.

Junction fitting 42 may be fluidly and mechanically connected by main leg 41 to main completion string 30 via a main leg connector pair 44. Main leg connector pair 44 may include a receptacle connector, which may be located within completion deflector 40, and a stinger connector, which may be located at the downhole main end of junction fitting 42. Main leg connector pair 44 may preferably be wet-matable and stabable.

As used herein, the term "connector pair" refers to a complete connection assembly consisting of a plug, or stinger connector together with a complementary receptacle connector, whether the connector pair is in mated state or a disconnected state. Wet-connect connector pairs may be sealed and designed so that the mating process displaces environmental fluid from the contact regions, thereby allowing connection to be made when submerged. Stabable connector pairs may be arranged so that the stinger connector is self-guided into proper alignment and mating with the receptacle connector, thereby simplifying remote connection.

Junction fitting 42 may be fluidly and mechanically connected at the downhole lateral end to lateral completion string 32. In an embodiment, the connection type may be such that junction fitting 42 may be subsequently removed from lateral completion string 32 while located within wellbore 12, thereby allowing removal of junction fitting 42 from well system 9 for enhanced access to main and lateral completion strings 30, 32 for workover operations and the like.

At its uphole end, junction fitting 42 may be connected to an anchoring device 50, an upper completion connector 52, and a tubing string 22 (with upper completion string segment 54). In an embodiment, upper completion connector 52 may also be wet-matable and stabable. In an embodiment, junction fitting 42 may be connected to anchoring device 50 via one or more lengths of casing 130, which may be characterized by a smaller outer diameter than the inner diameter of casing 16.

Anchoring device 50 may function to hold lateral completion string 32 in place within lateral wellbore 15 via junction fitting 42. However, lateral completion string 32 may also include an anchoring device 25, which may function to hold lateral completion string within lateral wellbore 15 should junction fitting 42 eventually need to be removed for servicing operations. Similarly, main completion string 30 may include an anchoring device 29 to hold main completion string 30 in place in main wellbore 13. Anchoring devices 25, 29, and 50 may be liner hangers or packers, for example, as described in further detail below.

Figure 2:
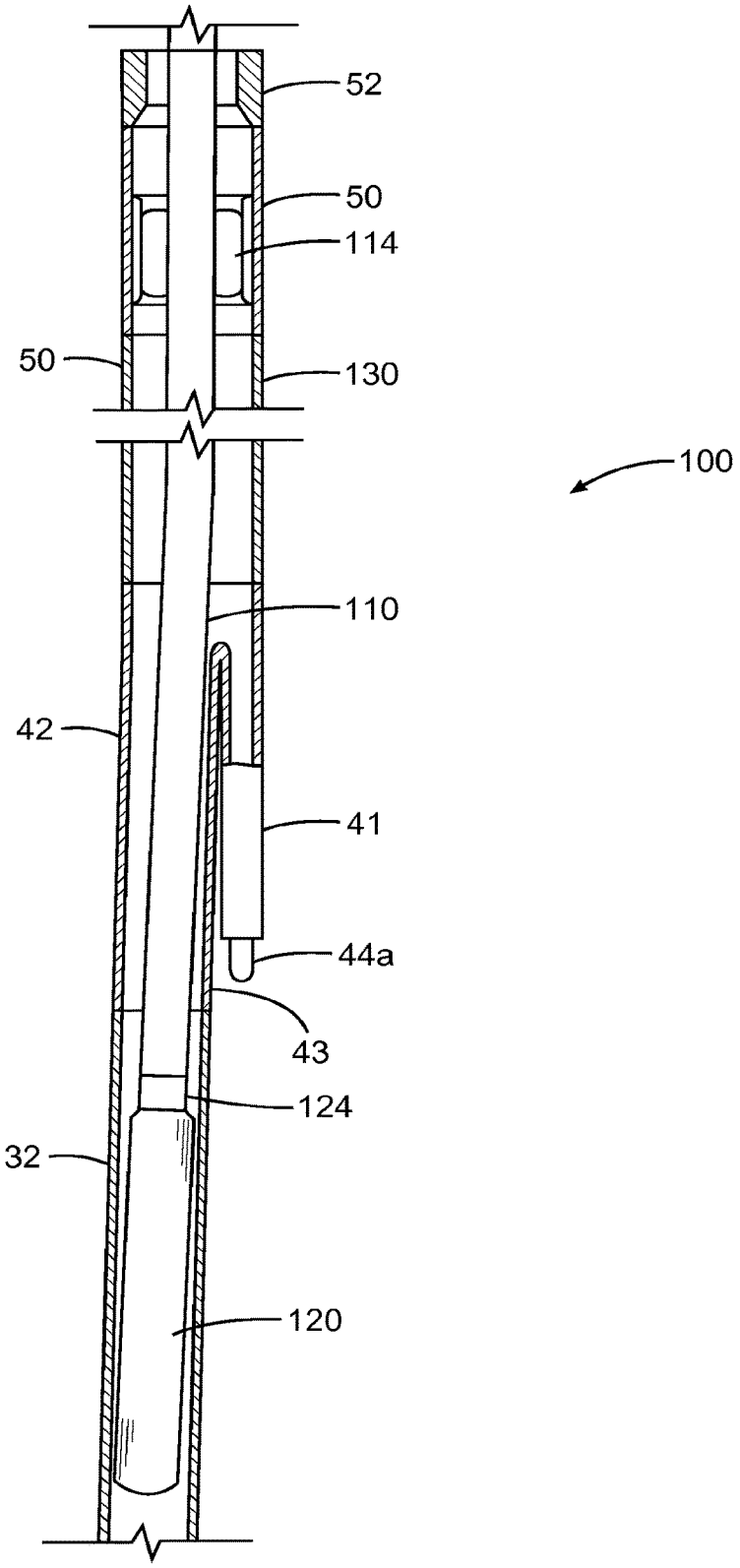
FIG. 2 is a simplified elevation view in partial cross section of a completion assembly according to a preferred embodiment, showing a junction fitting, lateral completion string, and anchoring device, housing and arranged to be conveyed by a working string with a completion tool assembly and a setting tool.

FIG. 2 is a simplified elevation view in partial cross section of a lateral wellbore completion assembly 100 according to one or more embodiments, shown prior to well completion operations. Lateral wellbore completion assembly 100 may include junction fitting 42, which may include a main leg 41 and a lateral leg 43. Main leg 41 may terminate with stinger 44*a* of main leg connector pair 44, which may be arranged for connection within a receptacle formed at the uphole end of completion deflector 40 (FIG. 1).

Lateral leg 43 of junction fitting 42 may be connected to lateral completion string 32. In an embodiment, the connection type may be such that junction fitting 42 may be subsequently removed from lateral completion string 32 while located within wellbore 12, thereby allowing removal of junction fitting 42 from the wellbore for enhanced access to main and lateral completion strings 30, 32.

The uphole end of junction fitting 42 may be connected to anchoring device 50. In one or more embodiments, anchoring device 50 may be a liner hanger or a packer. An upper completion connector 52 may be provided at the uphole end of anchoring device 50 for subsequent connection to the upper completion string segment 54 of tubing string 22 (FIG. 1), as described in greater detail below. In an embodiment, junction fitting 42 may be connected to anchoring device 50 by one or more lengths of casing 130. Casing 130 may have a smaller outer diameter than the inner diameter of casing 16 (FIG. 1).

A working string 110 may be included within lateral leg 43 of junction fitting 42, anchoring device 50, upper completion connector 52, and at least a portion of lateral completion string 32. Working string 110 may be any suitable oilfield tubular element including drill pipe, production tubing, et cetera, having the necessary strength and size to be lowered into and removed from wellbore 12 to position completion equipment within well system 9 (FIG. 1) and transfer materials into or out of the wellbore for various operations. The interior 111 of working string 110 may provide a first flow path. A second flow path may be provided by annulus 23 (FIG. 1). Fluids may be circulated within wellbore 12 using these first and second flow paths.

Working string 110 may include a setting tool 114, which may be removably connected to anchoring device 50 so that anchoring device 50 (and upper completion connector 52, junction fitting 42, and lateral completion string 32, which may be connected thereto) can be carried and run into wellbore 12 (FIG. 1) by working string 110. Accordingly, working string 110 may extend beyond upper completion connector 52 for manipulation from rig 10 (FIG. 1) for installation purposes. As described in further detail below, setting tool 114 and anchoring device 50 may be designed and arranged so that setting tool 114 can selectively set anchoring device 50 within wellbore 12, and thereafter setting tool 114 may be disconnected from anchoring device 50, allowing working string 110 to be freely conveyed within anchoring device 50, upper completion connector 52, junction fitting 42, and lateral completion string 32.

Working string 110 may also carry completion tool assembly 120, which may be located downhole of setting tool 114 within junction fitting 42 and/or lateral completion string 32. Completion tool assembly 120 may include various tools used in conjunction with gravel packing, fracturing, frac-packing, acidizing, cementing, perforating, and setting liner hangers, for example. Completion tool assembly 120 may also include various subs and/or blank pipe segments. The upper end of completion tool assembly 120 may be connected to working string 110 by completion tool connector 124, which in an embodiment may employ a ratch-latch type of connection. However, any suitable connector type may be used.

Figure 3A:
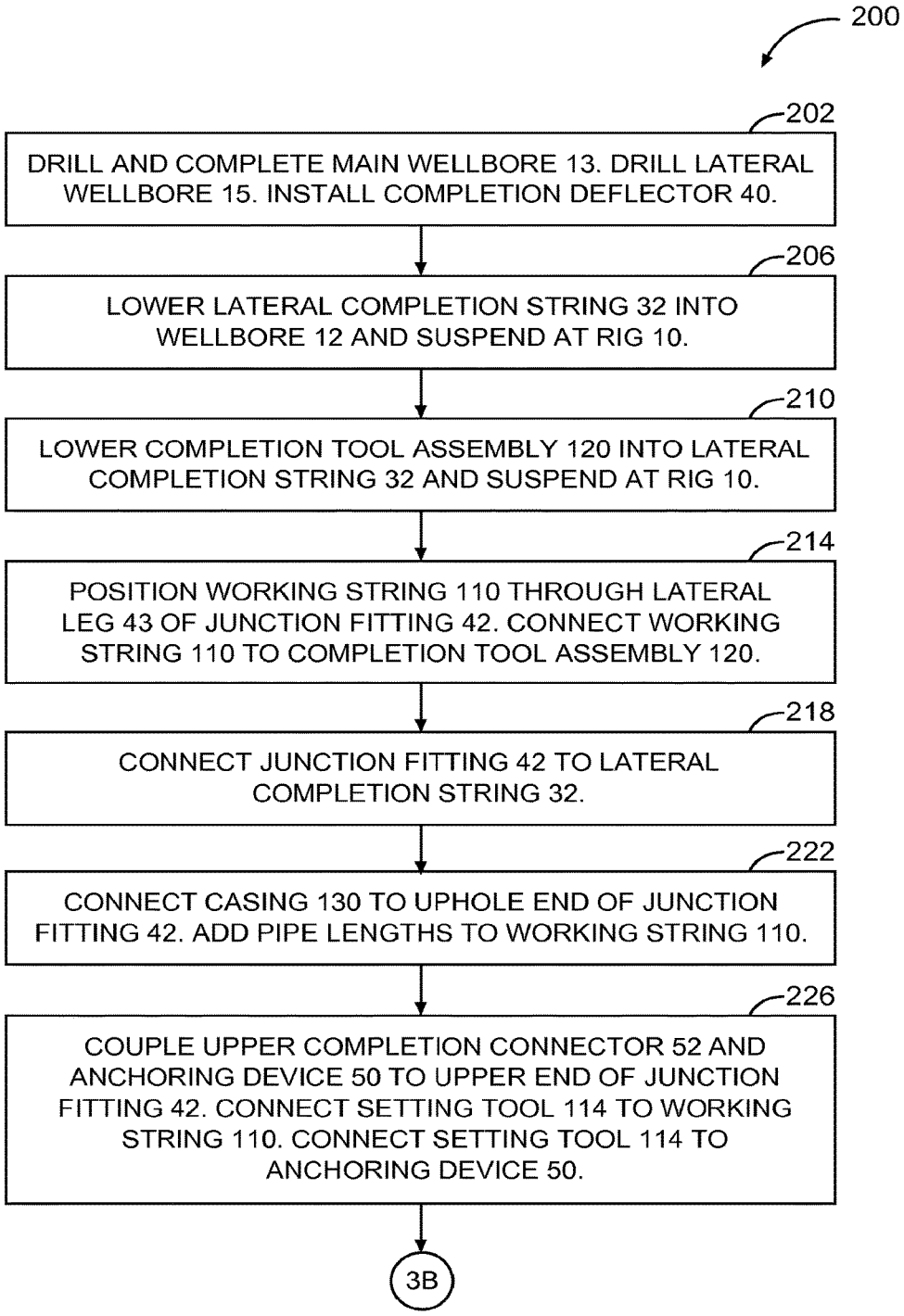
FIGS. 3A and 3B are flow charts of a method for completing a lateral wellbore according to an embodiment.
Figure 3B:
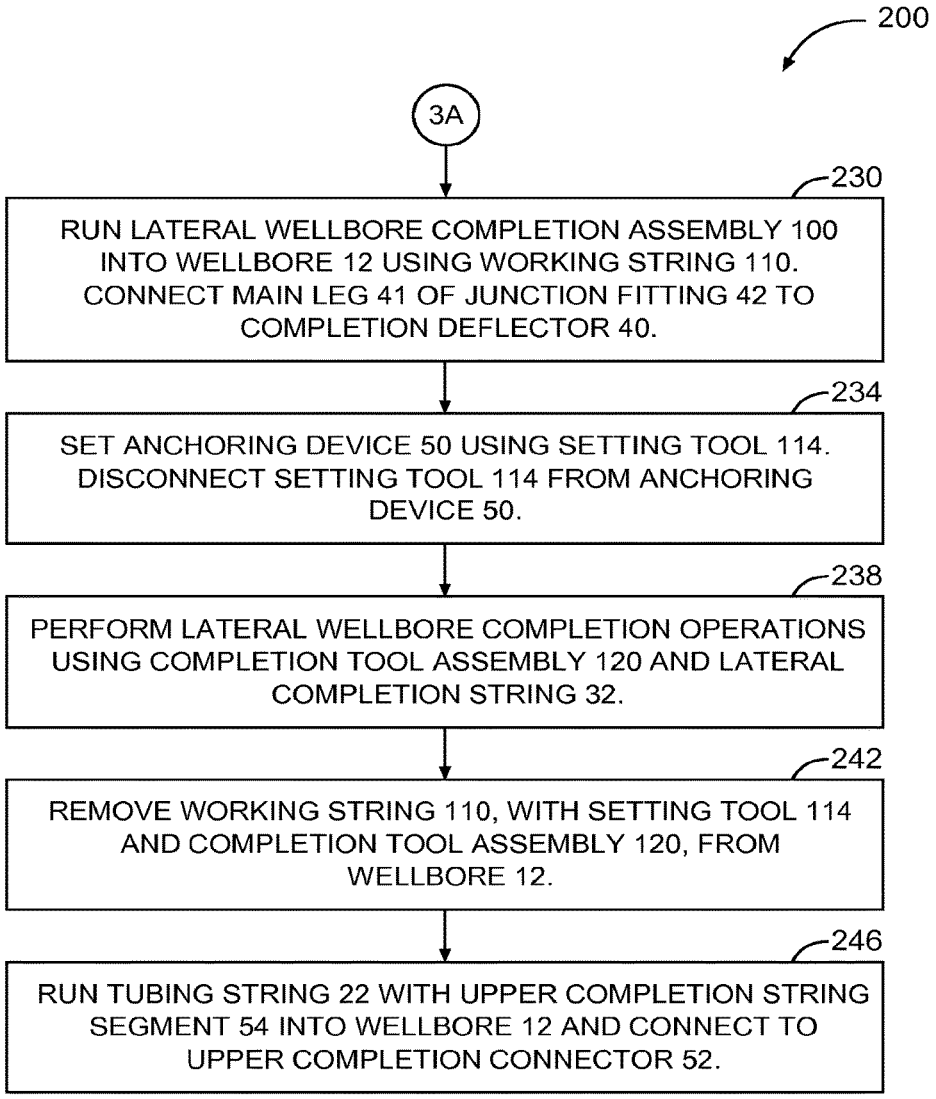

FIG. 3 is a flowchart of a method 200 for completion of wellbore 12 (FIG. 1) according to an embodiment. Referring to FIGS. 1-3, at step 202, main wellbore 13 may be drilled and completed, lateral wellbore 15 may be drilled, and completion deflector 40 may be installed. Completion deflector 40 may be installed by positioning it in main wellbore 13 adjacent the lateral wellbore junction. Completion deflector 40 may be attached, secured or otherwise joined to the upper end of main completion string 30 installed in main wellbore 13.

More specifically, according to step 202, one or more upper portions of main wellbore 13 may be first drilled and a casing 16 may be installed. After casing installation, a lower portion of main wellbore 13 may be drilled. Main wellbore completion operations may include gravel packing, fracturing, acidizing, cementing, and perforating, for example, as well as running and hanging main completion string 30, for example, from casing 16.

Main completion string 30 may be run in one or two stages. In the two stage process, a first portion of main completion string 30 may be attached to a working string, run into main wellbore 13, and various completion operations may be performed. The uphole end of the first main completion string portion may terminate with anchoring device 29, such as a packer or liner hanger, which may be set at or near the lower end 19 of casing 16 for suspending main completion string 30. Next, a deflector tool, such as a whipstock, may be run into the main wellbore and set at a predetermined position, and lateral wellbore 15 may be drilled, as described in greater detail below. Thereafter, a second portion of main completion string 30 may be attached to the working string, run into main wellbore 13, and connected to the first main completion string portion. The uphole end of the second main completion string portion terminates with completion deflector 40. In contrast, in the one stage process, the entire main completion string 30 may be run into main wellbore 13 in a single operation, and various main wellbore completion operations may be performed. The main completion string may be terminated at its uphole end with a combination whipstock/completion deflector (not specifically illustrated), and lateral wellbore 15 may then be drilled, as described below.

To initiate drilling of the lateral wellbore 15, a deflector tool, for example a whipstock or combination whipstock/completion deflector (not illustrated), may be set in main wellbore 13 at a predetermined position. A temporary barrier (not illustrated) may also be installed with the deflector tool to prevent fluid losses and to keep main wellbore 13 clear of debris generated while drilling lateral wellbore 15. The temporary barrier may be attached below the deflector tool or may be part of the deflector tool. If casing 16 is installed in main wellbore 13, a milling tool may then be run into the wellbore. The deflector tool deflects the milling tool into casing 16 to cut a window through the casing. The milling tool may then be replaced with a drill bit, and lateral wellbore 15 may be drilled. Lateral wellbore 15 may then be cased and cemented, or it may be left as an open, uncased wellbore. After lateral wellbore 15 is drilled, a retrieval tool may be attached to the working string and run into main wellbore 13 to connect to the deflector tool. The retrieval tool, whipstock (or removable upper portions of a combination whipstock/completion deflector tool, if any), and the temporary barrier, if installed, may then be withdrawn.

At step 206, lateral completion string 32 may be lowered into wellbore 12. In an embodiment, lateral completion string 32 may include filter assemblies 24 and packers 26. The upper end of lateral completion string 32 may be suspended by lower suspension mechanism 60 at rig 10.

At step 210, completion tool assembly 120 may be lowered into lateral completion string 32. The upper end of completion tool assembly 120 may then be held in place by upper suspension mechanism 66 at rig 10, which may be temporarily installed above lower suspension mechanism 60.

According to an embodiment, at step 214, an upper end of a lower portion of working string 110 may be connected to and suspended by swivel 74 at rig 10, while junction fitting 42 may be carried by elevator 72. The lower portion of working string 110, terminating at its downhole end with completion tool connector 124, may first be lowered through lateral leg 43 of junction fitting 42 and then into engagement with the uphole end of completion tool assembly 120. Completion tool connector 124, which in some embodiments may employ a ratch-latch type of connection, makes a secure, fluid-tight connection between working string 110 and completion tool assembly 120. After such a connection has been made, upper suspension system 66 may be disengaged and removed as required.

At step 218, the lateral downhole end of junction fitting 42, which may be suspended by working string 110 via elevator 72, may be lowered onto and connected with the uphole end of lateral completion string 32. Junction fitting 42 may be free to rotate relative to lateral completion string 32 for advancing threads as necessary. Once junction fitting 42 is connected to lateral completion string 32, lower suspension mechanism 60 may be removed.

Junction fitting 42 may then be lowered into wellbore 12, until its uphole end is at the elevation of lower suspension member 60. Lower suspension mechanism 60 may be used to suspend lateral completion string 32 and upper suspension mechanism 66 may be used to suspend working string 110 so that elevator 72 and swivel 74 may be disconnected from working string 110.

Alternatively, junction fitting 42 may be connected to lateral completion string 32 before completion tool 120 is positioned within lateral completion string 32. In this case, completion tool 120 may be connected to working string 110, and the pair may be run into lateral completion string 32 through the lateral leg of junction fitting 42.

According to step 222, one or more lengths of casing 130 may optionally be connected to the uphole end of junction fitting 42 in a manner substantially similar that described above with respect to steps 214 and 218. That is, while junction fitting 42 and working string 110 are suspended by lower and upper suspension mechanisms 60, 66, respectively, additional lengths of working string 110 and casing 130 may be added using swivel 74 and elevator 72.

Alternatively, casing 130 and junction fitting 42 may be connected to lateral completion string 32 before completion tool 120 is positioned within lateral completion string 32. In this case, completion tool 120 may be connected to working string 110, upper completion connector 52, anchoring device 50, and associated setting tool 114. Completion tool 120 may then be run into lateral completion string 32 through casing 130 and lateral leg 42 of junction fitting 42. Then, a bottom connector of anchoring device 50 may be connected to an upper connector of casing 130.

At step 226, upper completion connector 52, anchoring device 50, and associated setting tool 114 may be added to lateral wellbore completion assembly 100. According to an embodiment, upper completion connector 52 may be connected to the upper end of anchoring device 50. Setting tool 114 may be disposed within and removably attached to anchoring device 50, as described in further detail hereinafter. While casing 130 (or junction fitting 42 if casing 130 is not provided) may be suspended by lower suspension mechanism 60 and working string 110 may be suspended by upper suspension mechanism 66, setting tool 114 may be connected to working string 110 using rig 10. Upper completion connector 52 and anchoring device 50 may be carried along with setting tool 114. Upper completion connector 52 and anchoring device 50 may then be threaded to the uphole end of casing 130 (or junction fitting 42 if casing 130 is not provided) by rotating working string 110. The entire coaxial lateral wellbore completion assembly 100 may thereafter be carried by working string 110.

Alternatively, upper completion connector 52, anchoring device 50, casing 130, and junction fitting 42 may be connected to lateral completion string 32 before completion tool 120 is positioned within lateral completion string 32. In this case, completion tool 120 may be connected to working string 110, and the pair are run into lateral completion string 32 through upper completion connector 52, anchoring device 50, associated setting tool 114, casing 130, and lateral leg 43 of junction fitting 42.

Alternatively, upper completion connector 52, anchoring device 50, casing 130, and junction fitting 42 may be connected to lateral completion string 32 before completion tool 120 and setting tool 114 are positioned within lateral completion string 32 and anchoring device 50, respectively. In this case, completion tool 120 and setting tool 114 may be connected to working string 110, and then completion tool 120 may be run into through upper completion connector 52, anchoring device 50, casing 130, and lateral leg 43 of junction fitting 42 into lateral completion string 32. Simultaneously, setting tool 114 may be positioned so it can be connected to anchoring device 50.

At step 230, lateral wellbore completion assembly 100 may be run into wellbore 12 in a typical manner, alternately engaging and disengaging lower suspension mechanism 60 to hold and release working string 110 as new stands of pipe are added to it. When the distal end of lateral completion string 32 contacts inclined surface 45 of completion deflector 40, lateral completion string 32 may be deflected into lateral wellbore 15. Lateral wellbore completion assembly 100 may be run until stinger 44*a* of main leg connector pair 44 is received within the receptacle formed at the uphole end of completion deflector 40, thereby fluidly and mechanically coupling main leg 41 of junction fitting 42 to main completion string 30.

At step 234, setting tool 114 may be operated to set anchoring device 50 fast within wellbore 12, as described in greater detail below. Anchoring device 50 may be a liner hanger having slips and elastomeric seals or the like that expand to grip and seal against the interior surface of casing 16. Setting tool 114 may thereafter be released from anchoring device 50 to allow working string 110, and completion tool assembly 120 carried therewith, to be moved freely within lateral completion string 32.

At step 238, completion operations within lateral wellbore 15 may be completed using completion tool assembly 120 and lateral completion string 32. Completion operations may include gravel packing, fracturing, frac-packing, acidizing, cementing, perforating, and setting liner hangers, for example.

After lateral wellbore completion operations have been performed, at step 242, working string 110, with completion tool 120 and setting tool 114, may be tripped out of wellbore 12. Completion tool 120 may be dimensioned so as to pass through lateral leg 43 of junction fitting 42. Setting tool 114 may also be dimensioned so as to pass through lateral leg 43 of junction fitting 42.

Finally, at step 246, tubing string 22, with upper completion string segment 54, may be run into wellbore 12 and connected to upper completion connector 52. In an embodiment, upper completion connector 52 may be wet-matable and stabable.

Each trip into the wellbore to position equipment or perform an operation requires additional time and expense. By running completion tool 120 into lateral wellbore 15 concurrently with running and installing junction fitting 42 in wellbore 12, and removing completion tool 120 through lateral leg 43 of junction fitting 42 once completion operations are finished, a trip and concomitant expense may be saved.

Figure 4A:
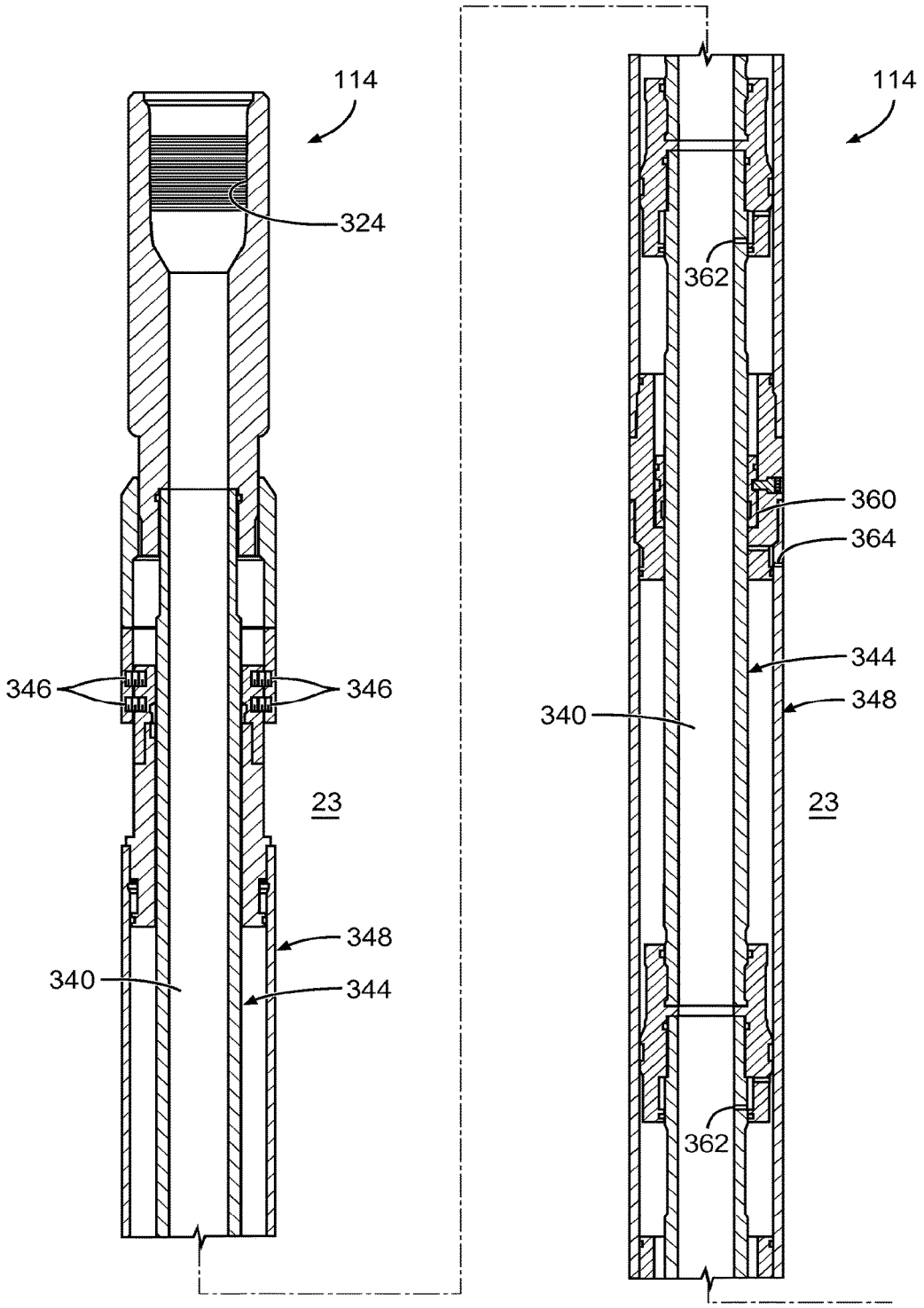
FIGS. 4A-4C are longitudinal cross sections of one embodiment of an anchoring device and associated setting tool of FIG. 2 shown in a run-in configuration, wherein the setting tool is fixed to the anchoring device.
Figure 4B:
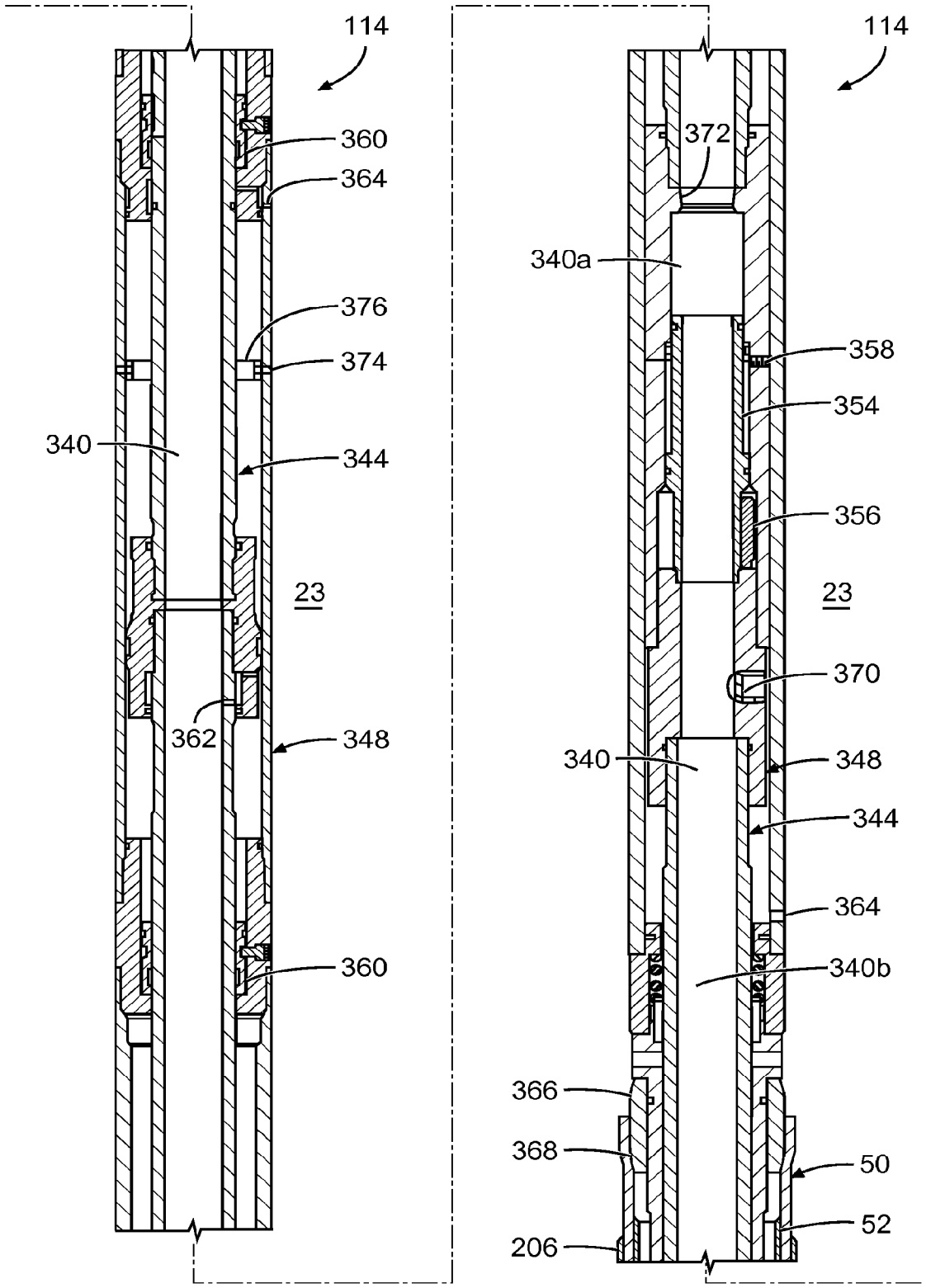
Figure 4C:
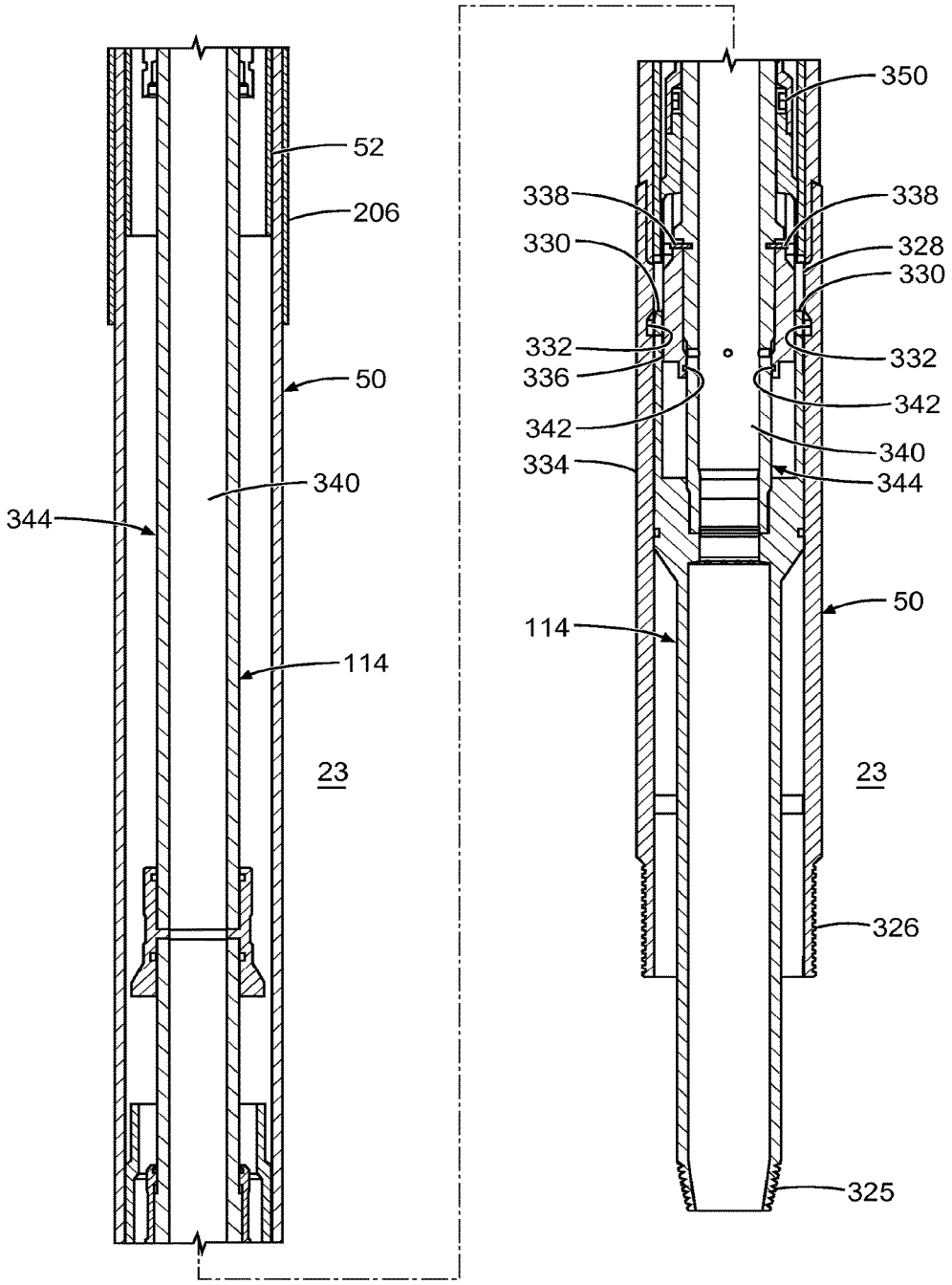

FIGS. 4A-4C are detailed cross-sectional views of successive axial portions of anchoring device 50, in the form of a liner hanger, and setting tool 114, according to one or more embodiments. Other configurations and embodiments may be possible and fall within the scope of this disclosure.

Anchoring device 50 and setting tool 114 are shown in FIGS. 4A-4C in a configuration in which they may be conveyed into wellbore 12 (FIG. 1). Setting tool 114 may be connected within working string 110 (FIG. 2) by upper and lower threaded connectors 324, 325 (FIGS. 4A, 4C), respectively. Anchoring device 50 may include at its upper end upper completion string connector 52 (FIGS. 4B and 4C) for connection to tubing string 22 and upper completion string segment 54 (FIG. 1) and at its lower end lower threaded connection 326 for connection to casing 130 or the upper end of junction fitting 42.

Setting tool 114 may be releasably secured to the anchoring device 50 by means of an anchor 328 (FIG. 4C) which may include collets 330 engaged within recesses 332 formed in a setting sleeve 334 of anchoring device 50. When operatively engaged within recesses 332 and outwardly supported by a support sleeve 336, collets 330 may permit transmission of torque and axial force between setting tool 114 and anchoring device 50.

Support sleeve 336 may be retained in position, outwardly supporting collets 330 by shear pins 338. However, if sufficient pressure is applied to an internal flow passage 340 of setting tool 114, a piston area defined between seals 342 may cause shear pins 338 to shear and support sleeve 336 to displace downwardly, thereby no longer supporting collets 330 and allowing them to disengage from recesses 332. In addition, anchor 328 may be released by downwardly displacing a generally tubular inner mandrel 344 assembly through which flow passage 340 extends.

A set of shear screws 346 may releasably retain inner mandrel 344 in position relative to an outer housing assembly 348 of setting tool 114. If sufficient downward force is applied to the inner mandrel 344 (such as, by slacking off working string 110 (FIG. 2) after anchoring device 50 has been set), shear screws 346 may shear and permit downward displacement of inner mandrel relative to outer housing assembly 348.

Figure 5:
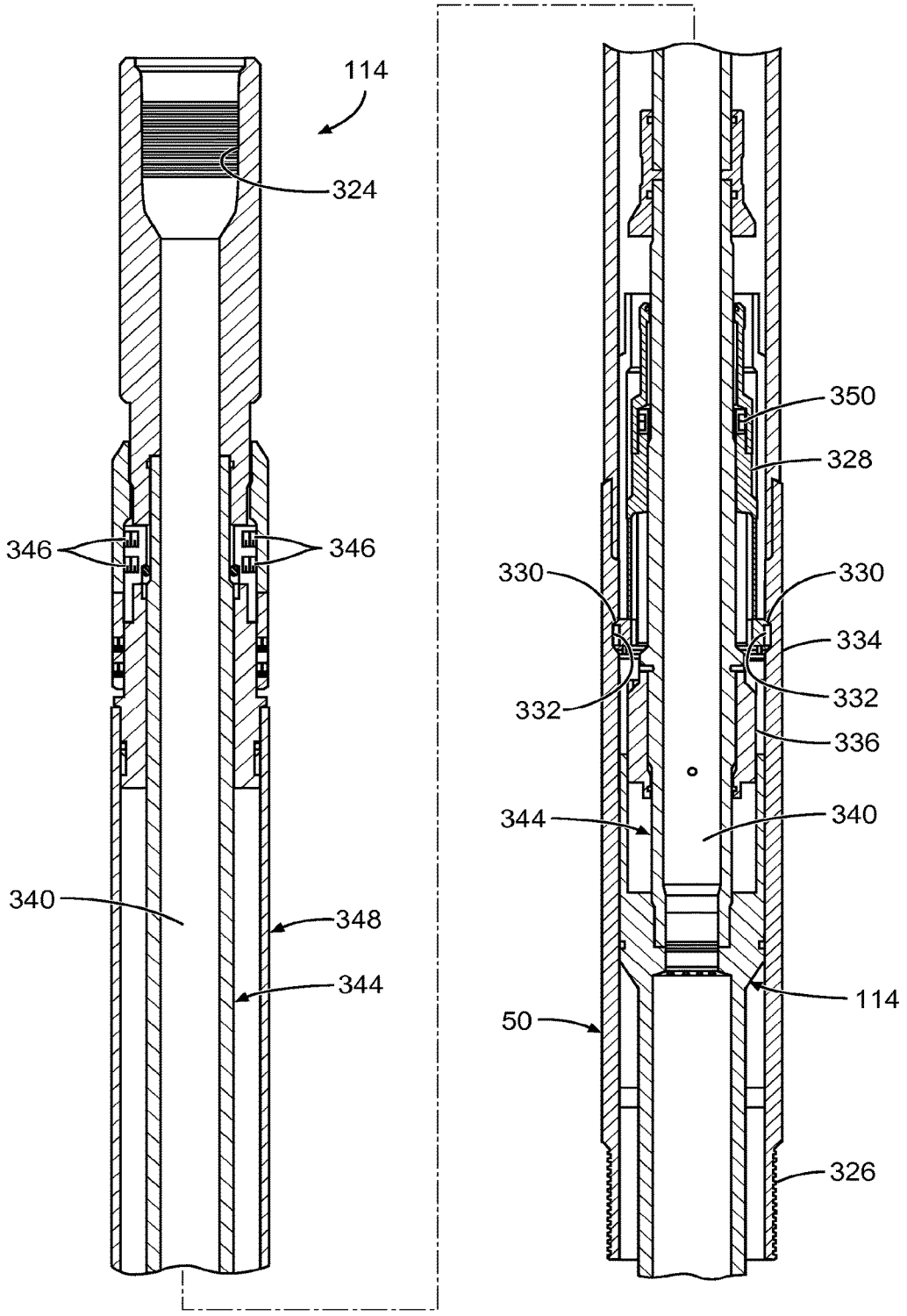
FIG. 5 is a longitudinal cross section of the upper and lower portions of the anchoring device and associated setting tool of FIGS. 4A and 4C, respectively, showing the setting tool in the process of being disengaged from the anchoring device.

FIG. 5 illustrates the upper and lower portions of setting tool 114 and anchoring device 50 that correspond to FIGS. 4A and 4C, respectively, shown after inner mandrel 344 has been displaced downward relative to outer housing assembly 348. Sheared shear screws 346 and the manner in which the inner mandrel 344 is downwardly displaced are visible. Collets 330 are no longer outwardly supported by support sleeve 336. Collets 330 may now be released from recesses 332 by raising inner mandrel 344 with working string 110 (FIG. 2). Locking dogs 350 may prevent support sleeve 336 from again supporting collets 330 as inner mandrel 344 is raised.

Referring back to FIGS. 4A-4C, setting tool 114 may be actuated to set the anchoring device 50 by applying increased pressure to flow passage 340 (via the interior of working string 110 (FIG. 2)) to thereby increase a pressure differential between flow passage 340 and the exterior of setting tool 114 (i.e., annulus 23). At a predetermined pressure differential between flow passage 340 and annulus 23, a shear pin 358 retaining a valve sleeve 354 may shear, valve sleeve 354 may be displaced upwardly, and a flapper valve 356 may shut. The shutting of flapper valve 356 may isolate an upper portion 340*a* of flow passage 340 from a lower portion 340*b* of the flow passage (FIG. 4B). The shut flapper valve 356, however, may allow pressure to be equalized between flow passage portions 340*a*, 340*b* once the increased pressure applied to the flow passage 340 via working string 110 (FIG. 2) is released.

Pressure in upper flow passage portion 340*a* may then be increased again (such as, by applying increased pressure to working string 110 (FIG. 2)) to apply a pressure differential across three pistons 360 interconnected in outer housing assembly 348 (FIGS. 4A and 4B). An upper side of each piston 360 may be exposed to pressure in flow passage 340 via ports 362 formed through inner mandrel 344, and a lower side of each piston may be exposed to pressure in annulus 23 via ports 364 formed through outer housing assembly 348.

A venting device 370 may be provided below flapper valve 356. Venting device 370 may vent lower flow passage portion 340*b* to annulus 23 (via one of the ports 364) if a pressure differential across the venting device reaches a predetermined set point. The venting device 370 may be a rupture disk, but other types of venting or pressure relief devices may be used.

An expansion cone 366 may be positioned at a lower end of outer housing assembly 348. Expansion cone 366 may have a lower frusto-conical surface 368 formed thereon which may be driven through the interior of anchoring device 50 to outwardly expand anchoring device 50. The term "expansion cone" as used herein is intended to encompass equivalent structures such as wedges or swages, regardless of whether such structures include conical surfaces.

In an embodiment, only a small upper portion of anchoring device 50 overlaps expansion cone 366. This configuration may beneficially reduce the required outer diameter of setting tool 114. The differential pressure across pistons 360 may cause each of the pistons to exert a downwardly biasing force on expansion cone 366 via outer housing assembly 348. The combined biasing force may drive expansion cone 366 downwardly through the interior of anchoring device 50, thereby setting anchoring device 50.

Once outer housing assembly 348 has been displaced downward a predetermined distance relative to inner mandrel 344, a closure 376 may be contacted and displaced by inner mandrel 344 to thereby open port 374 (FIG. 4B) and provide fluid communication between annulus 23 and an upper side of one of the pistons 360, thereby providing a noticeable pressure drop within working string 110 (FIG. 2) to indicate that the setting operation has been successfully concluded.

With the anchoring device 50 expanded, one or more external seals 380 (FIG. 4C) on the exterior of anchoring device 50 may engage the interior of casing 16 (FIG. 1) for sealing and gripping. Inner mandrel 44 may now be displaced downwardly (i.e., by slacking off working string 110 (FIG. 2)) to release anchor 328 as described above. Setting tool 114, working string 110, and completion tool assembly 120 (FIG. 2) may then be freely moved.

Although three pistons 360 are disclosed herein, any greater or lesser number of pistons may also be used. If greater biasing force is needed for a particular setting tool/liner hanger configuration, then more pistons 360 may be provided. Greater biasing force may also be obtained by increasing a piston area of each of the pistons 360.

Completion operations may include gravel packing. Open hole wellbores in unconsolidated producing formations may contain fines and sand which flow with fluids produced from the formations. The sand in the produced fluids can abrade and otherwise damage tubing, pumps, et cetera and should preferably be removed from the produced fluids. Accordingly, filter assemblies may be installed in completion strings, and the filter assemblies may be gravel packed within the wellbore to help filter out the fines and sand in the produced fluids.

In general, gravel pack installation equipment used to install the filter assemblies and gravel may include a working string having a packer and crossover assembly and a wash pipe extending below the crossover assembly to the bottom of the filter assembly. When properly positioned for gravel packing, the packer may seal the annulus between the working string and the wellbore above the filter assembly. A gravel packing slurry, i.e. liquid plus a particulate material, may be dispensed through the working string to the crossover assembly, which may direct the slurry into the annulus below the packer. The slurry may flow to the filter assembly, which may filter out the particulate, depositing a gravel pack around the screen. The fluid may then flow through the filter assembly, into the wash pipe, and back up to the crossover assembly, which may direct the return flow into the annulus above the packer.

Completion operations may also include cementing. In general, cementing equipment may provide a flow path through which liquid cement may be delivered from a working string into an annulus between a casing, liner, or other oilfield tubular element and a wellbore wall. Because the wellbore may normally be filled with a fluid, e.g. drilling fluid, completion fluid, etc., cementing equipment may also include a return flow path for fluid displaced by cement during the cementing operation. A packer may be used to prevent cement from entering the annulus between the working string and the casing, liner, et cetera.

Figure 6:
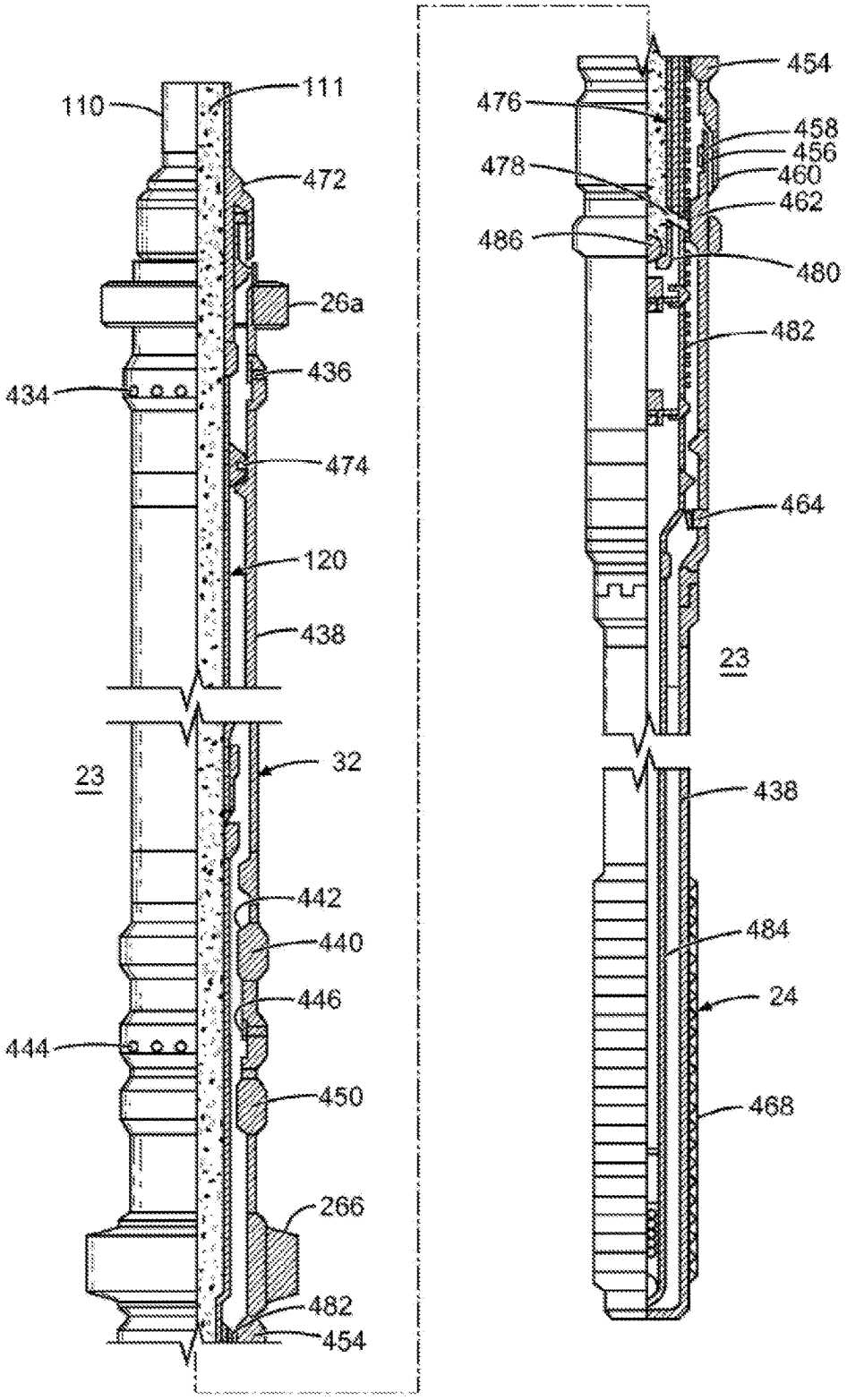
FIG. 6 is a longitudinal cross section of one embodiment of a completion tool assembly located within a portion of a lateral completion string of FIG. 2.

FIG. 6 is a longitudinal cross section of completion tool assembly 120 located within a portion of a lateral completion string 32 according to an embodiment. Referring to FIGS. 1 and 6, completion tool assembly 120 of FIG. 6 may be a combined cementing and gravel packing tool assembly, which may provide selective flow paths for gravel packing, cementing, cleaning and, if desired, inflating packers. However, any suitable completion tool assembly may be used as appropriate.

Lateral completion string 32 may include one or more filter assemblies 24 and packers 26, interconnected with sections of blank pipe 438. Lateral completion string 32 may also include various ports, valves and bore seals, which may selectively interact with completion tool assembly 120, as described below.

For example, a first packer **26*a* may be provided, which may be a combination packer/hanger to resist axial movement of the lateral completion string 32 in wellbore 15. Packer 26*a* may provide a fluid-tight seal between lateral completion string 32 and either a cased or uncased wall of wellbore 15**.

An upper cementing port 434 may be located downhole of first packer **26*a*. Upper cementing port 434 may include a sleeve valve 436 that allows upper cementing port 434 to be selectively opened or shut. In the run-in position, the valve 436** is preferably shut.

Below port 434, blank pipe 438 may be included along lateral completion string 32. Blank pipe 438 may be a conventional oil field tubular element, such as steel pipe. The length of blank pipe 438 may be selected based on the location of producing formation 21 and/or the desired location of filter assembly 24. Blank pipe 438 may pass through curved or deviated portions of wellbore 15 and may be of considerable length.

A first seal bore 440 having an inner sealing surface 442 may be located downhole of blank pipe 438. Seal bore 440 may include a thick wall coupling or length of pipe having a polished inner seal bore surface 442 having a precise inner diameter less than the minimum inner diameter of blank pipe 438. Alternatively, seal bore 440 may be a coupling or length of pipe having an inner sealing surface 442 formed of an elastomeric material, such as one or more O-rings. As described in more detail below, completion tool assembly 120 may carry a seal body 482 to seal against sealing surface 442. If the sealing surface 442 is a polished metal surface, completion tool assembly 120 may carry a matching elastomeric seal body 482. If the sealing surface 442 includes an elastomeric element, then, completion tool assembly 120 may carry a matching polished metal seal body 482.

A lower cementing port 444, including a sleeve valve 446, may be located downhole of seal bore 440. Sleeve valve 446 may allow lower cementing port 444 to be selectively opened or shut. In the run-in position, sleeve valve 446 is preferably shut. The lower cementing port 444 may also include a spring-biased one-way check valve that allows fluid flow out of port 444 into annulus 23, but prevents flow from annulus 23 into port 444. Other forms of one-way valves may be used if desired. A second seal bore 450, which may be substantially similar to first seal bore 440 described above, may be located downhole of lower cementing port 444.

A second packer 26*b* may be located below second seal bore 450. A third seal bore 454 may be located below second packer 26*b*. A gravel packing port 456 may be located downhole of third seal bore 454. Gravel packing port 456 may include a sleeve valve 458, that allows gravel packing port 456 to be selectively opened or shut. In the run-in position, valve 458 is preferably shut. Gravel packing port 456 may include an outer shroud 460, which may direct fluids flowing out of gravel packing port 456 downwardly to avoid erosion of the wall of borehole 15. A fourth seal bore 462 may be positioned below gravel packing port 456. A flapper valve 464 may be located below fourth seal bore 462. While a flapper valve 464 is shown, other fluid loss control devices, for example a ball valve, may also be used as appropriate.

Filter assembly 24 may be located below flapper valve 464 and in an embodiment, as shown in FIG. 6, may serve to terminate the distal end of lateral completion string 32. Filter assembly 24 may include a screen 468. Other forms of filters, such as slotted pipe or perforated pipe, may be used in place of screen 468 if desired. Blank pipe 438 may connect filter assembly 24 as part of lateral completion string 32.

Completion tool assembly 120 may be connected at its upper end to working string 110. Completion tool assembly 120 may include a packer setting tool 472 near its upper end. Packer setting tool 472 may used to set packer 26*a*, and it may be similar in construction to setting tool 114 (FIGS. 4A-4C) described above.

Completion tool assembly 120 may include a shifter 474 for opening and closing various sleeve valves 436, 446 and 458 as completion tool assembly 120 is moved down and up within lateral completion string 32. Completion tool assembly 120 may also include a crossover assembly, shown generally at 476. Crossover assembly 476 may include a crossover port 478 that may be in fluid communication with the interior 111 of working string 110 and a crossover channel 480 that may be in fluid communication with annulus 23.

As mentioned above, seal body 482 may be provided. Seal body 482 may be carried on the cylindrical outer surface of crossover assembly 476 and may extend above and below crossover port 478. Seal body 482 may be formed as a separate metal sleeve having a plurality of elastomeric rings on its outer surface. The outer diameter of the elastomeric rings may be slightly greater, e.g. 0.010 to 0.025 inch greater, than the inner diameter of seal bores 440, 450, 454 and 462. In such an arrangement, seal bores 440, 450, 454 and 462 may have polished metal inner surfaces, e.g. 442.

Alternatively, the inner surfaces of seal bores 440, 450, 454 and 462 may include elastomeric elements such as O-rings, and seal body 482 may be only a metal sleeve having a polished outer surface with an outer diameter somewhat larger than the inner diameter of the elastomeric elements of seal bores 440, 450, 454 and 462.

In either case, seal body 482 may form fluid-tight seals with seal bores 440, 450, 454 and 462 at any point along the length of the seal body 482. Seal body 482 may have sufficient length above and below crossover port 478 to form seals with seal bores 440 and 450 at the same time or with seal bores 454 and 462 at the same time.

The lowermost portion of the completion tool assembly 120 may include a wash pipe 484, which may extend through flapper valve 464 and into filter assembly 24.

In operation, from the run-in configuration shown in FIG. 6, first packer 26*a* may first be set using packer setting tool 472, introducing a drop ball 486 through interior 111 of working string 110, and increasing then pressure within interior 111. Crossover port 478 may be located at the lowermost seal bore 462 below gravel packing port 456. Seal body 482 may contact seal bore 462 both above and below crossover port 478, thereby preventing flow into or out of crossover port 478. Drop ball 486 may isolate interior 111 of working string 110 from annulus 23, both above and below upper packer 26*a*. Increasing pressure in annulus 23 uphole of set first packer 26*a* may function to set second packer 26*b*.

In an embodiment, drop ball 486 may be the same ball used to set anchoring device 50 (FIG. 2) by using a pump-through ball sub (not illustrated). A pump-through ball sub may function to hold and seal a drop ball while anchoring device 50 is being set. Thereafter, additional pressure may be applied to release the drop ball, which may then be pumped further downhole to set first packer 26*a*.

After both packers 26*a*, 26*b* have been set, completion tool assembly 120 may be repositioned for gravel packing filter assembly 24. By lifting working string 110, crossover port 478 may be positioned in fluid communication with gravel packing port 456 by positioning seal body 482 to contact seal bores 454 and 462 above and below crossover port 478 respectively. A gravel packing slurry may then be pumped down working string 110 and through crossover port 478 and gravel packing port 456 into annulus 23. As with typical gravel packing, the liquid portion of the slurry may flow through screen 468 of filter assembly 24, while the particulate may accumulate within annulus 23 to form a gravel pack around filter assembly 24. The liquid portion may then flow up wash pipe 484, through crossover channel 480, and return through annulus 23 above upper packer 26*a*.

In the gravel packing configuration, completion tool assembly 120 may also be used to perform treatments other than or in addition to gravel packing, such as fracturing or acidizing, both of which require dispensing a fluid down interior 111 of working string 110 into formation 21 surrounding filter assembly 24. By preventing return flow through annulus 23, high pressure may be applied to force the treatment fluids into formation 21.

Working string 110 may be positioned to move crossover port 478 uphole of seal bore 454 while leaving seal body 482 in sealing contact with seal bore 454 below port 478. In this position, fluid may be reverse circulated down annulus 23, into crossover port 478, and up interior 111 of working string 110 to remove any remaining gravel packing slurry or treatment fluid from annulus 23 and working string 110.

Working string 110 may also be positioned for cementing blank pipe 438 above second packer 26*b*. Working string 110 may be first lifted to position sleeve shifter 474 above sleeve valves 436 and 446 and then lowered to open sleeve valves 436 and 446 in the upper and lower cementing ports 434 and 444. In this cementing position, crossover port 478 may be in fluid communication with lower cementing port 444. Seal body 482 may make sealing contact with seal bores 440 and 450, above and below crossover port 478 respectively. Cement may be pumped down interior 111 of working string 110, through crossover port 478 and lower cementing port 444, and into annulus 23. The cement may then flow up annulus 23 towards upper cementing port 434.

Lower cementing port 444 may include a spring-biased check valve. The spring bias may be adjusted to set a minimum pressure at which cement can be pumped through the valve and to provide positive closing of the check valve when pumping has stopped.

After pumping of cement is stopped, working string 110 may again be lifted a short distance so that crossover port 478 is positioned above seal bore 440, and seal body 482 below port 478 may form a seal with seal bore 440. Clean fluid may then be circulated down interior 111 of working string 110, through crossover port 478 and back up annulus 23 to clean out any excess cement. If desired, the circulation may be reversed.

FIG. 6 illustrates only a single filter assembly 24 located below blank pipe 438. However, as shown in FIG. 1, there may be multiple producing zones, and it may be desirable to provide and gravel pack a filter assembly 24 in each zone. In addition, a plurality of filter assemblies 24 may be positioned along the length of the horizontal portion of a wellbore that may pass through a single producing zone.

Accordingly, lateral completion string 32 of lateral wellbore completion assembly 100 (FIG. 2) may include a plurality of filter assemblies 26 intervaled in series with lengths of blank pipe 438. Each filter assembly 24 may also be associated with a packer 26, gravel packing port 456 and seal bores 454 and 462 positioned relative to packer 26, and gravel packing port 456. Each filter assembly 24 may also be associated with a seal bore 450 positioned above each packer 26. The processes described above may then be used to selectively inflate each packer 26 and to sequentially gravel pack each filter assembly 24. When all filter assemblies 26 have been gravel packed, blank pipe 438 may then be cemented as described above.

In summary, a completion assembly and a method for completing a well have been described. Embodiments of the completion assembly may generally have: A generally wye-shaped tubular junction fitting defining an uphole end, a main leg terminating at a downhole main end, and a lateral leg terminating at a downhole lateral end; a completion string connected to one of the main leg and the lateral leg of the junction fitting; a completion tool assembly disposed within the completion string; an anchoring device coupled to the junction fitting; a setting tool at least partially disposed within and removably connected to the anchoring device; and a working string carrying the completion tool assembly and the setting tool, the working string passing through the one of the main leg and the lateral leg of the junction fitting. Embodiments of the method for completing a wellbore may generally include: Running a completion tool assembly into one of the lateral wellbore and the main wellbore concurrently with running and installing a junction fitting at an intersection of the lateral wellbore and the main wellbore; and then removing the completion tool assembly from the one of the lateral wellbore and the main wellbore through the junction fitting.

Any of the foregoing embodiments may include any one of the following elements or characteristics, alone or in combination with each other: At least one of the group consisting of a gravel packing tool, a cementing tool, a perforating tool, a crossover assembly, an isolation packer, a screen assembly, and a fracturing tool; a completion tool connector carried along the working string connecting the completion tool assembly to the working string; the a completion tool connector includes a ratch-latch connection; the anchoring device is connected to the uphole end of the junction fitting; the completion tool assembly is dimensioned so as pass through the one of the main leg and the lateral leg of the junction fitting; a seal stinger connected to the other of the main end and the lateral end of the junction fitting, the seal stinger dimensioned to be received within a completion deflector, the anchoring device is a liner hanger, a length of casing connected between the junction fitting and the anchoring device; the completion string includes a filter assembly and a packer, the completion string is a lateral completion string connected to the lateral leg of the junction fitting; running a completion string into the one of the lateral wellbore concurrently with the running and installing the junction fitting; coupling the junction fitting to an anchoring device; disconnectably carrying the anchoring device by a setting tool; carrying the setting tool and the completion tool assembly by a working string; lowering the completion tool assembly and the junction fitting into the well via the working string; passing the working string through h a lateral leg of the junction fitting; running the completion tool assembly and a lateral completion string into the lateral wellbore concurrently with running and installing a junction fitting at the intersection of the lateral wellbore and the main wellbore; removing the completion tool assembly from the lateral wellbore through the lateral leg of the junction fitting; setting the anchoring device within the main wellbore by the setting tool; disconnecting the setting tool from the anchoring device; selectively conveying the completion tool assembly within the lateral wellbore by the working string; performing a completion operation by the completion tool assembly; the completion tool assembly includes a gravel packing tool; performing a gravel packing operation within the lateral wellbore by the completion tool assembly; the completion tool assembly includes a cementing tool; performing a cementing operation within the lateral wellbore by the completion tool assembly; lowering a portion of the lateral completion string into the wellbore; lowering the completion tool assembly into the lateral completion string; connecting the junction fitting to the lateral completion string; connecting a portion of the working string to the completion tool assembly through the junction fitting; connecting the portion of the working string to the completion tool assembly using a ratch-latch connection; disposing the setting tool within the anchoring device; connecting the setting tool to the anchoring device; connecting the setting tool to the portion of the working string; coupling the anchoring device to the junction fitting; connecting the anchoring device to the junction fitting with at least one length of casing; providing a filter assembly and a packer along the lateral completion string; positioning a completion deflector in the main wellbore; deflecting the lateral completion string into the lateral wellbore by the completion deflector; connecting the junction fitting to the completion deflector; and connecting an upper completion string segment to the anchoring device.

The Abstract of the disclosure is solely for providing a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A method for completing a well having a main wellbore and a lateral wellbore, comprising:

running a completion tool assembly into one of said lateral wellbore and said main wellbore concurrently with running and installing a junction fitting at an intersection of said lateral wellbore and said main wellbore; and then removing said completion tool assembly from said one of said lateral wellbore and said main wellbore through said junction fitting;

coupling said junction fitting to an anchoring device;

disconnectably carrying said anchoring device by a setting tool;

carrying said setting tool and said completion tool assembly by a working string; and lowering said completion tool assembly and said junction fitting into said well via said working string.

2. The method of claim 1 further comprising:

running a completion string into said one of said lateral wellbore concurrently with said running and installing said junction fitting.

3. The method of claim 1 further comprising:

passing said working string through h a lateral leg of said junction fitting;

running said completion tool assembly and a lateral completion string into said lateral wellbore concurrently with running and installing a junction fitting at said intersection of said lateral wellbore and said main wellbore; and then removing said completion tool assembly from said lateral wellbore through said lateral leg of said junction fitting.

4. The method of claim 3 further comprising:

setting said anchoring device within said main wellbore by said setting tool;

disconnecting said setting tool from said anchoring device; then selectively conveying said completion tool assembly within said lateral wellbore by said working string; and performing a completion operation by said completion tool assembly.

5. The method of claim 3 wherein:

said completion tool assembly includes a gravel packing tool; and the method further comprises performing a gravel packing operation within said lateral wellbore by said completion tool assembly.

6. The method of claim 3 wherein:

said completion tool assembly includes a cementing tool; and the method further comprises performing a cementing operation within said lateral wellbore by said completion tool assembly.

7. The method of claim 3 further comprising:

lowering a portion of said lateral completion string into said wellbore;

lowering said completion tool assembly into said lateral completion string; then connecting said junction fitting to said lateral completion string; and then connecting a portion of said working string to said completion tool assembly through said junction fitting.

8. The method of claim 7 further comprising:

connecting said portion of said working string to said completion tool assembly using a ratch-latch connection.

9. The method of claim 7 further comprising:

disposing said setting tool within said anchoring device;

connecting said setting tool to said anchoring device; then connecting said setting tool to said portion of said working string; and then coupling said anchoring device to said junction fitting.

10. The method of claim 9 further comprising:

connecting said anchoring device to said junction fitting with at least one length of casing.

11. The method of claim 3 further comprising:

providing a filter assembly and a packer along said lateral completion string.

12. The method of claim 3 further comprising:

positioning a completion deflector in said main wellbore;

deflecting said lateral completion string into said lateral wellbore by said completion deflector; and connecting said junction fitting to said completion deflector.

13. The method of claim 3 further comprising:

connecting an upper completion string segment to said anchoring device.

* * * * *